US011330360B2

(12) United States Patent
Tsuchihashi

(10) Patent No.: US 11,330,360 B2
(45) Date of Patent: May 10, 2022

(54) HEADPHONE

(71) Applicant: Yamaha Corporation, Hamamatsu (JP)

(72) Inventor: Yu Tsuchihashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/168,482

(22) Filed: Feb. 5, 2021

(65) Prior Publication Data

US 2021/0266656 A1 Aug. 26, 2021

(30) Foreign Application Priority Data

Feb. 25, 2020 (JP) ..... JP2020-029167

(51) Int. Cl.

| | |
|---|---|
| ***G10K 11/16*** | (2006.01) |
| ***H04R 1/10*** | (2006.01) |
| ***G10K 11/172*** | (2006.01) |
| ***H04R 1/28*** | (2006.01) |

(52) U.S. Cl.

CPC ..... *H04R 1/1083* (2013.01); *G10K 11/172* (2013.01); *H04R 1/1008* (2013.01); *H04R 1/1041* (2013.01); *H04R 1/2811* (2013.01)

(58) Field of Classification Search

CPC .. H04R 1/2811; H04R 1/1041; H04R 1/1083; G10K 11/172

USPC ..... 381/71.1, 71.6

See application file for complete search history.

(56) References Cited

U.S. PATENT DOCUMENTS

2016/0295315 A1 10/2016 Kuwahara et al.

FOREIGN PATENT DOCUMENTS

| | | | | |
|---|---|---|---|---|
| JP | 2019-103012 A | 6/2019 | | |
| WO | WO 2015/076006 A1 | 5/2015 | | |
| WO | WO-2015076006 A1 * | 5/2015 | ..... | G10K 11/178 |

* cited by examiner

*Primary Examiner* — Ammar T Hamid
(74) *Attorney, Agent, or Firm* — Crowell & Moring LLP

(57) ABSTRACT

A headphone includes an electro-acoustic transducer, a housing, a noise cancelling circuit, a resonant frequency converter, and a switch. The electro-acoustic transducer is configured to reproduce sound from electrical signals. The housing is attached to the electro-acoustic transducer. The noise cancelling circuit is configured to attenuate a noise sound by adding an antiphase sound to the noise sound. The resonant frequency converter is configured to change a resonant frequency of a Helmholtz resonator configured to include a cavity in the housing and a tubular cavity communicating with the cavity. The switch is configured to perform alteration of the resonant frequency and switching of the noise cancelling circuit, in conjunction with each other.

9 Claims, 10 Drawing Sheets

HEADPHONE

CROSS-REFERENCE TO RELATED APPLICATION

The present application claims priority from Japanese patent application JP2020-29167 filed on Feb. 25, 2020, the contents of which are hereby incorporated by reference into this application.

BACKGROUND

1. Field

The present disclosure relates to a headphone.

2. Description of the Related Art

Some headphones are capable of listening to music with ambient noise off. For example, by picking up noise with a microphone and generating sound waves of opposite phase, it is possible to cancel the sound waves of the noise. Such noise cancelling by phase is suitable to cancel the noise in the low-frequency band.

To increase the performance of the noise canceling, the amplitude of the low-frequency band should be relatively large in frequency characteristics. On the other hand, adapting the acoustic characteristics of the headphone, to improve the noise cancelling performance, causes a problem that the balance of the frequency characteristics is lost when the noise canceling is turned off.

SUMMARY

An object of the present disclosure is to achieve both high-performance noise canceling and high sound quality.

This and other objectives are achieved by an inventive headphone, which includes an electro-acoustic transducer configured to reproduce sound from electrical signals; a housing to which the electro-acoustic transducer is attached; a noise cancelling circuit configured to attenuate a noise sound by adding an antiphase sound to the noise sound; a resonant frequency converter adapted to change a resonant frequency of a Helmholtz resonator configured to include a cavity in the housing and a tubular cavity communicating with the cavity; and a switch adapted to perform alteration of the resonant frequency and switching of the noise cancelling circuit, in conjunction with each other.

The inventive headphone enables change of the acoustic characteristics depending on whether the noise canceling is turned on or off, thereby balancing the high-performance noise canceling and the high sound quality. This and other objects, advantages and novel features of the present disclosure will become apparent from the following detailed description of one or more preferred embodiments when considered in conjunction with the accompanying drawings, in which:

DETAILED DESCRIPTION

The embodiment(s) of the present invention is (are) described below with reference to the drawings. However, the embodiments of the present invention can be implemented in various ways to the extent that it does not deviate from the main point of view, and is not to be construed as being limited to the description of the embodiment(s) exemplified below.

Figure 1:
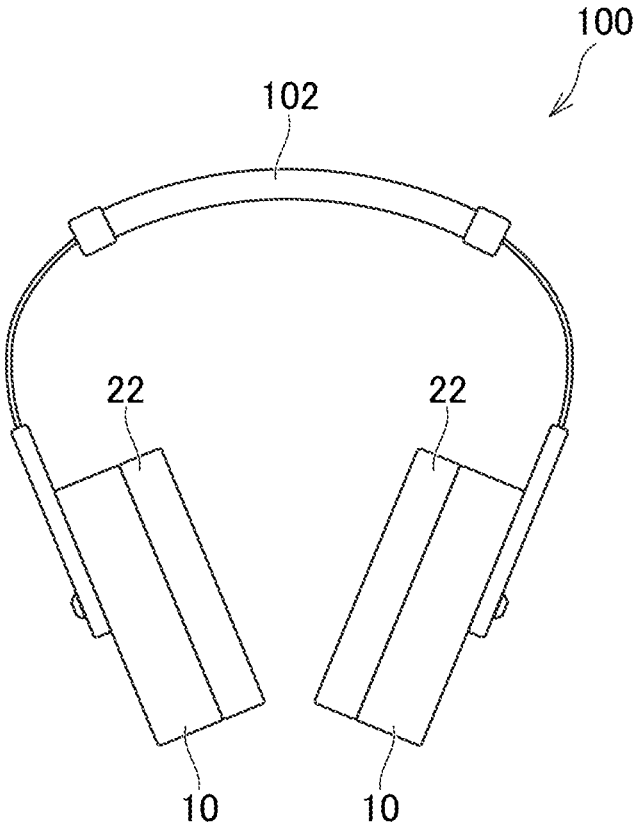
FIG. 1 is an overall diagram of a headphone.

FIG. 1 is an overall view of a headphone. The headphone 100 is connected to an unillustrated audio device (such as a music player, an audio mixer, or a smart phone) by wire or wirelessly. The headphone 100 has a headband 102 and a pair of housings 10. An earphone shall be a kind of the headphone 100.

Figure 2:
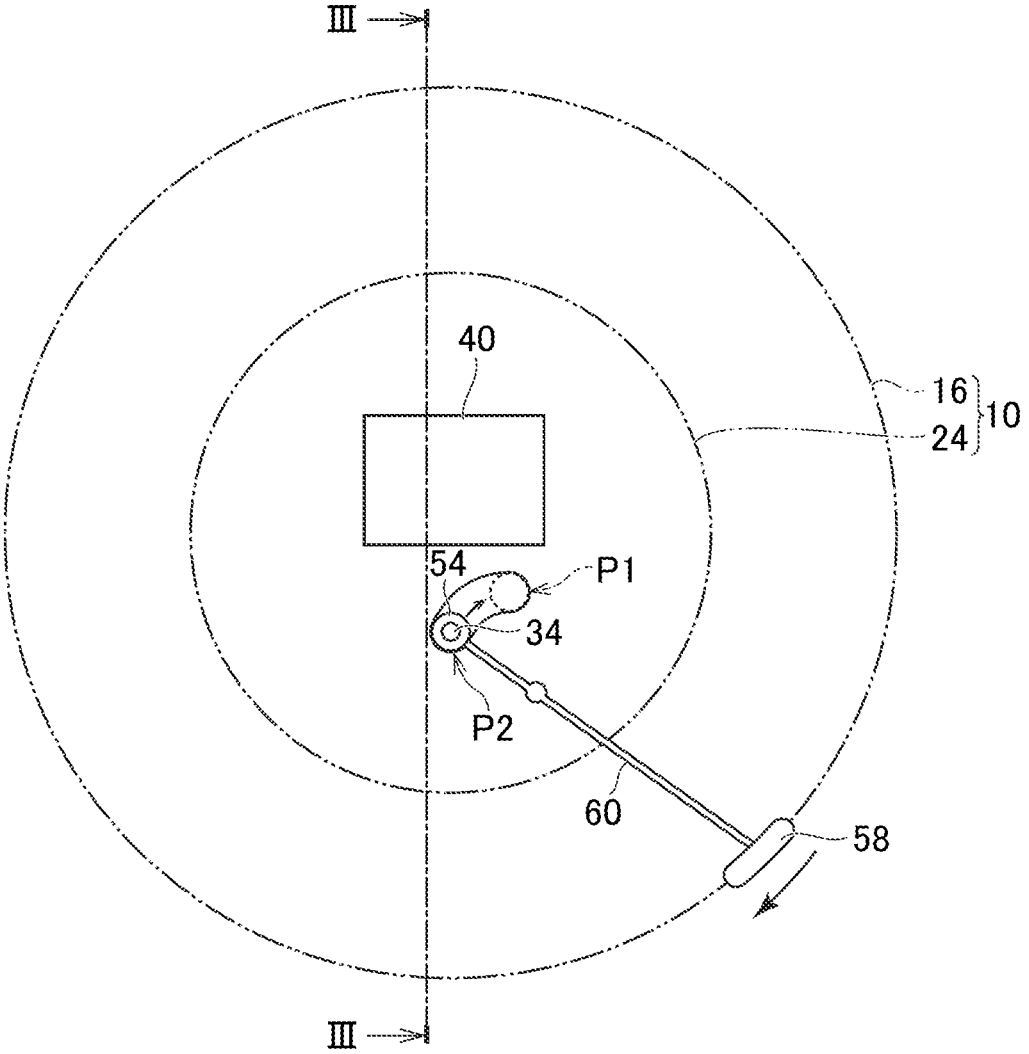
FIG. 2 is a plan view of a housing.
Figure 3:
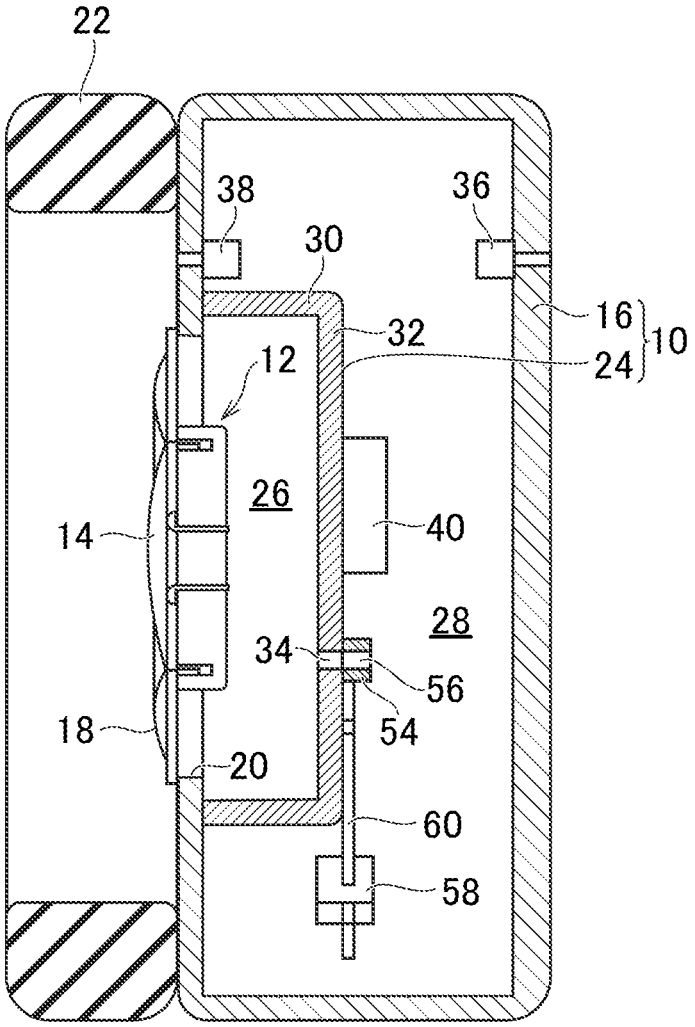
FIG. 3 is a cross-sectional view of the housing in FIG. 2.
Figure 4:
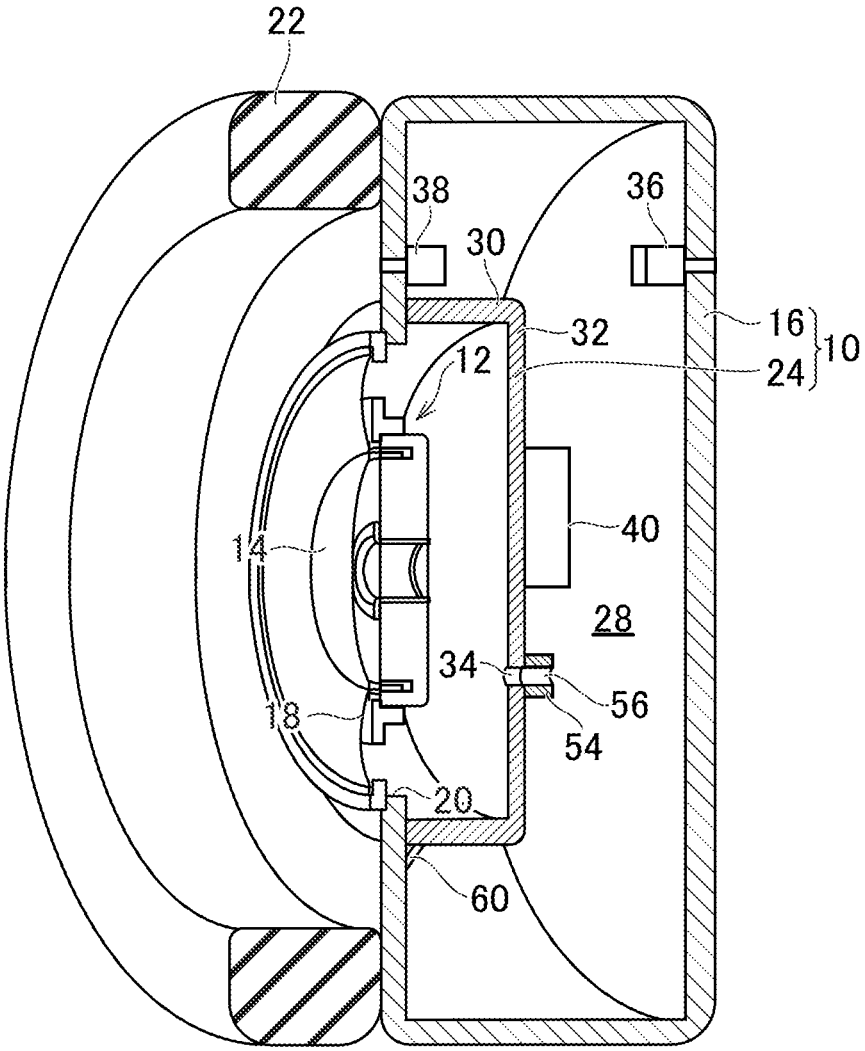
FIG. 4 is a perspective view of the housing in FIG. 3.

FIG. 2 is a plan view of the housing 10. FIG. 3 is a cross-sectional view of the housing 10 in FIG. 2. FIG. 4 is a perspective view of the housing 10 in FIG. 3. The housing 10 is equipped with an electro-acoustic transducer 12. The electro-acoustic transducer 12 is configured to reproduce sound from electrical signals of original sound such as music. A dynamic type is configured to supply a current through a coil based on the electric signals, and reproduce the sound by vibrating a diaphragm 14 by magnetic force.

The housing 10 includes an outer case 16. The outer case 16 has an output opening 20 in an output surface 18 arranged to face a user's ear. On the output surface 20, the diaphragm 14 of the electro-acoustic transducer 12 is mounted to close the output opening 20. An ear cup 22 is mounted on the output surface 18, surrounding the output opening 20 and the electro-acoustic transducer 12. The outer case 16, in addition to the output opening 20, may have a hole (port) configured to adjust the acoustic characteristics.

The housing 10 includes an inner case 24. With the inner case 24, an inner space of the outer case 16 is partitioned into a front space 26 in which the electro-acoustic transducer 12 is located and a rear space 28. For example, the inner case 24 is attached to a rear surface of the output surface 18, including a side wall portion 30 surrounding the electro-acoustic transducer 12 and a lid portion 32 for closing the space surrounded by the side wall portion 30. The inner case 24 is configured to cover the electro-acoustic transducer 12. The inner case 24 has a through-hole 34 penetrating between the front space 26 and the rear space 28. In addition to the through-hole 34, the inner case 24 may have a hole (port) configured to adjust the acoustic characteristics.

The headphone 100 has a noise canceling function to attenuate a noise sound by adding an antiphase sound to the noise sound. The noise canceling uses a first microphone 36 and a second microphone 38. The first microphone 36 is configured to pick up a noise such as an external noise or an environmental noise. The second microphone 38 is configured to pick up a listening sound that enters the user's ear. The headphone 100 has an electrical board 40 in the housing 10. The electrical board 40 is disposed, for example, between the inner case 24 and the outer case 16.

Figure 5:
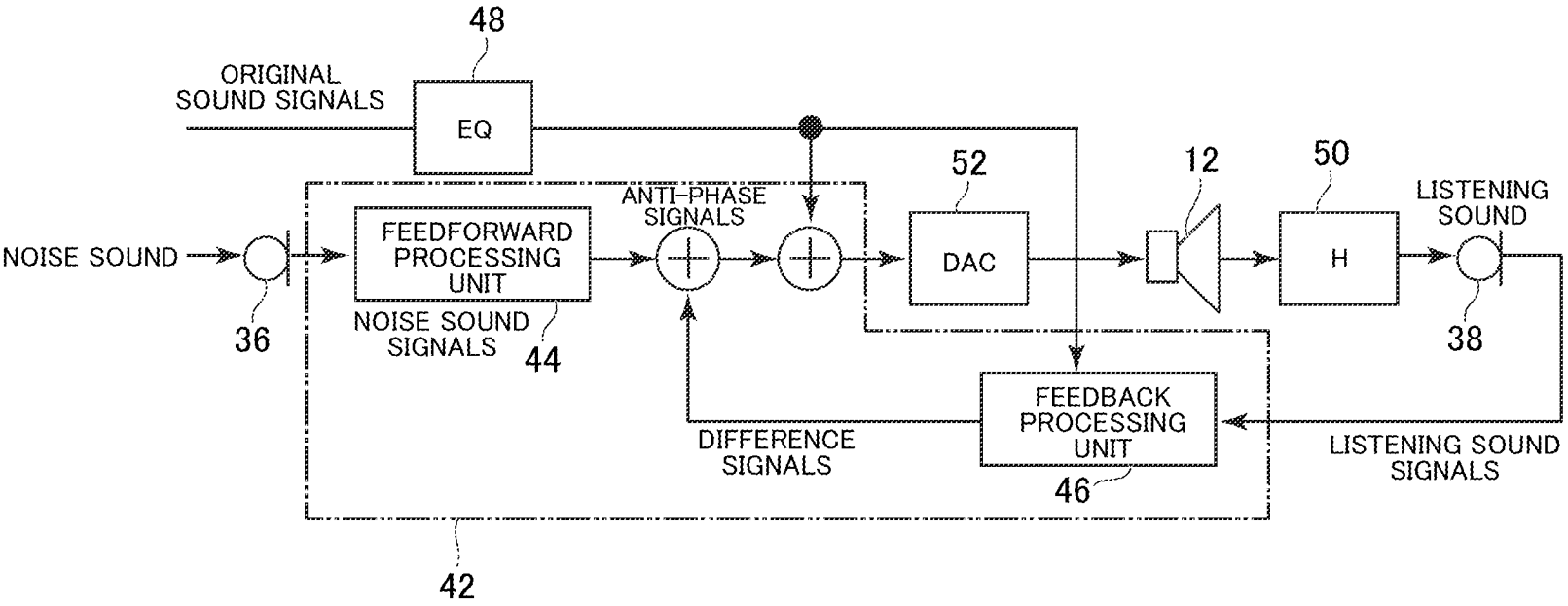
FIG. 5 is a block diagram of a noise canceling.

FIG. 5 is a block diagram of the noise canceling. Circuits of the electrical board 40 include a noise canceling circuit 42. The noise canceling circuit 42 includes a feedforward processing unit 44 and a feedback processing unit 46.

The noise sound is picked up by the first microphone 36, converted into noise sound signals to be output. The noise sound signals are input to the feedforward processing unit 44. The feedforward processing unit 44 inverts the phase of the noise sound signals, and generates and outputs anti-phase signals, which are adjusted if necessary.

The original sound signals, which are electric signals corresponding to the original sound such as music, are adjusted by an equalizer (EQ) 48, if necessary, added to the anti-phase signals from the feedforward processing unit 44, and input to the feedback processing unit 46.

The sound reproduced by the electro-acoustic transducer 12 is affected by the transfer function (H) 50 of the space surrounded by the electro-acoustic transducer 12, the housing 10 (outer case 16), the ear cup 22, and the user's ear, thereby forming the listening sound entering the user's ear. The listening sound is picked up by the second microphone 38, converted into the listening sound signals to be output. The listening sound signals are input to the feedback processing unit 46. The feedback processing unit 46 outputs difference signals for canceling the difference between the listening sound signals and the original sound signals. The difference signals are added to the anti-phase signals output from the feedforward processing unit 44.

The sum of the original signals, the anti-phase signals, and the difference signals, which is digital signals, is converted into analog signals by a D/A converter (DAC) 52, and input to the electro-acoustic converter 12. In this way, the sound to which the noise canceling is applied is reproduced.

As shown in FIGS. 3 and 4, the headphone 100 has an adapter 54. The adapter 54 has an auxiliary through-hole 56. The adapter 54 is movable. At the second position P2 shown in FIG. 2, the adapter 54 is disposed so that the auxiliary through-hole 56 communicates with the through-hole 34. The adapter 54 is movable to the first position P1. At the first position P1, the adapter is disposed so that the auxiliary through-hole 56 avoids communication with the through-hole 34. By sliding a switch 58 outside the housing 10 (outer case 16) in the direction of an arrow, it is possible to move the adapter 54. Specifically, the switch 58 and the adapter 54 are connected to each other with a rod 60, the rod 60 is swung by the slide movement of the switch 58, and the adapter 54 moves along a curve.

The switch 58 is also adapted to switch on and off the noise canceling circuit 42. Specifically, when the adapter 54 is disposed at the first position P1, the noise canceling circuit 42 is turned on. When the adapter 54 is disposed at the second position P2, the noise canceling circuit 42 is turned off. Thus, the switch 58 is adapted to perform the alteration of the position of the adapter 54 in conjunction with the switching of the noise canceling circuit 42.

The housing 10 has a Helmholtz resonator configured therein. The resonant frequency of the Helmholtz resonator depends on the volume of the cavity, the length of the tubular cavity communicating with the cavity, and the cross-sectional area of the tubular cavity. The resonant frequency is inversely proportional to each of the volume of the cavity and the length of the tubular cavity, and is directly proportional to the cross-sectional area of the tubular cavity. The Helmholtz resonator provides a sound reduction effect at the resonant frequency at the aperture of the tubular cavity.

In the headphone 100, the cavity of the Helmholtz resonator is inside the housing 10. The Helmholtz resonator includes a first Helmholtz resonator having a cavity in the front space 26 and a second Helmholtz resonator having a cavity in the rear space 28.

The through-hole 34 in the inner case 24 is at least part of the tubular cavity of the Helmholtz resonator. When the adapter 54 is at the second position P2, the auxiliary through-hole 56 and the through-hole 34 communicate with each other, and both constitute a tubular cavity of the Helmholtz resonator. When the adapter 54 is at the first position P1, the through-hole 34 constitutes a tubular cavity of the Helmholtz resonator.

The headphone 100 has a resonant frequency converter (e.g., rod 60). The resonant frequency converter is adapted to change the resonant frequency of the Helmholtz resonator. For example, the rod 60 moves the adapter 54 to change the length of the tubular cavity. The resonant frequency converter is adapted to change any one of the cross-sectional area of the tubular cavity, the length of the tubular cavity, and the volume of the cavity.

The switch 58 is adapted to perform the alteration of the resonance frequency and the switching of the noise canceling circuit 42, in conjunction with each other. The switch 58 alters the position of the adapter 54 between the first position P1 and the second position P2.

Figure 9:
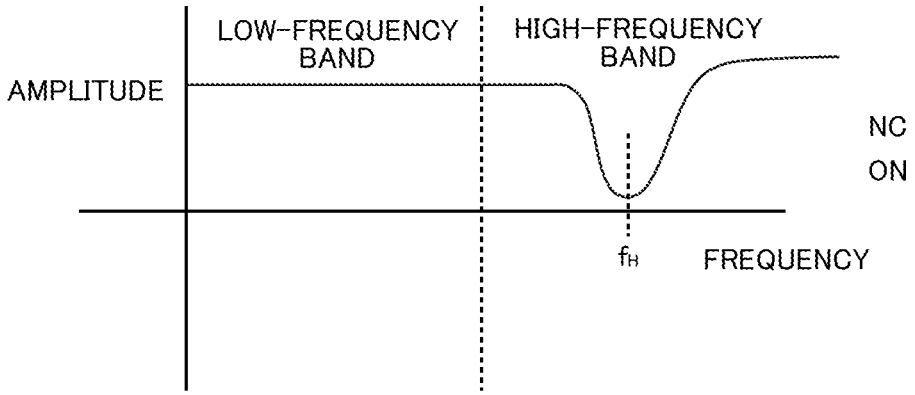
FIG. 9 is a diagram of frequency characteristics at a first position.

At the first position P1, the adapter 54 is disposed so that the auxiliary through-hole 56 avoids communication with the through-hole 34. Since the entire tubular cavity is formed from the through-hole 34, its length is reduced, the resonance frequency is increased. At the first position P1, where the noise canceling circuit 42 is turned on, the resonance frequency is higher than when turned off. That is, the frequency band at which the sound reduction effect can be obtained is high. FIG. 9 is a graph of the frequency characteristics at the first position P1. At the first position P1, the resonant frequency is $f_H$, and the amplitude of the high-frequency band is small, so that the amplitude of the low-frequency band becomes relatively large. Therefore, the noise canceling effect can be made higher in performance.

Figure 10:
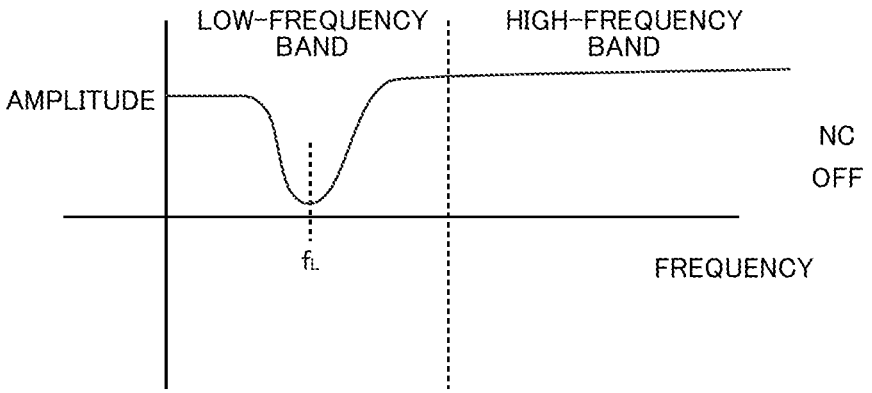
FIG. 10 is a diagram of frequency characteristics at a second position.

At the second position P2, the adapter 54 is disposed so that the auxiliary through-hole 56 communicates with the through-hole 34. Since the tubular cavity is formed from the through-hole 34 and the auxiliary through-hole 56, the length is increased, and the resonance frequency is lowered. At the second position P2, where the noise canceling circuit 42 is turned off, the resonance frequency is lower than when turned on. That is, the frequency band at which the sound reduction effect is obtained is low. FIG. 10 is a graph of the frequency characteristics at the second position P2. At the second position P2, the resonant frequency is $f_L$, and the amplitude of the low-frequency band is small, so that the amplitude of the high-frequency band becomes relatively large. Therefore, it is possible to obtain properly balanced frequency characteristics.

The present embodiment enables change of the acoustic characteristics depending on whether the noise canceling is turned on or off, thereby balancing the high-performance noise canceling and the high sound quality.

Figure 6:
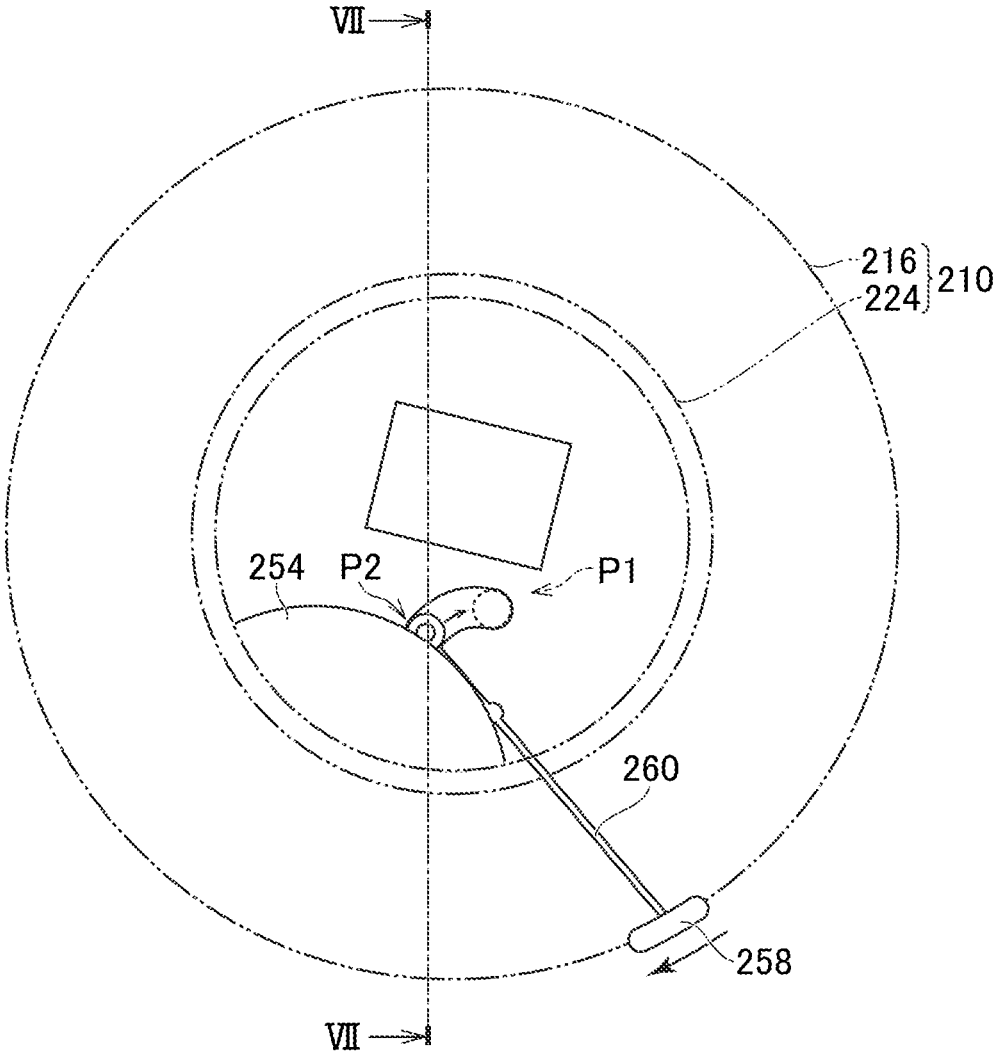
FIG. 6 is a plan view of a housing.
Figure 7:
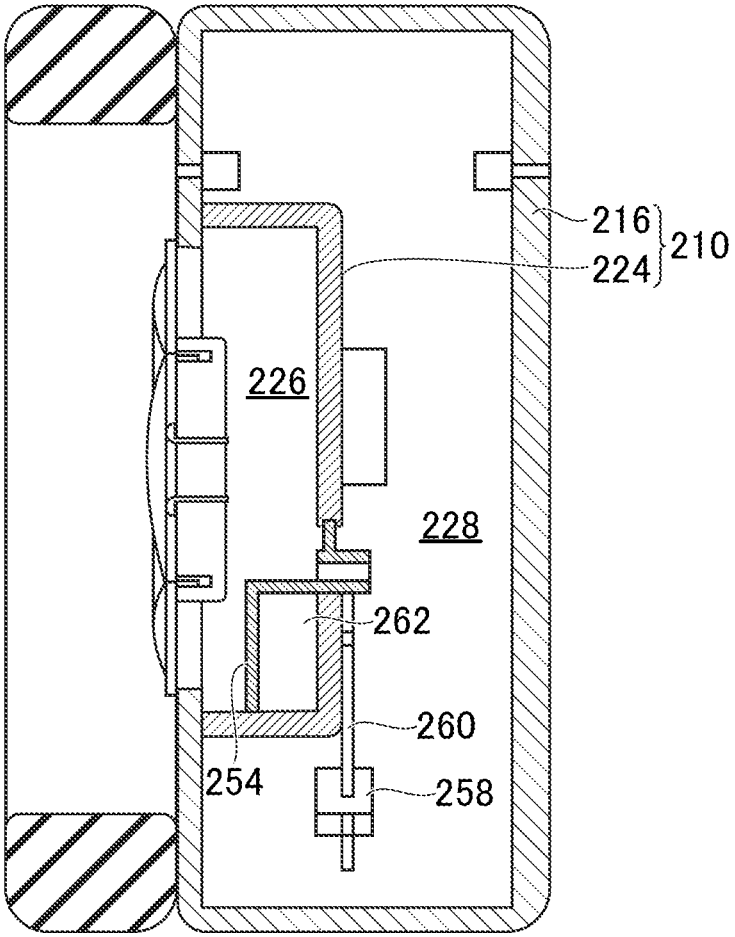
FIG. 7 is a VII-VII cross-sectional view of the housing in FIG. 6.
Figure 8:
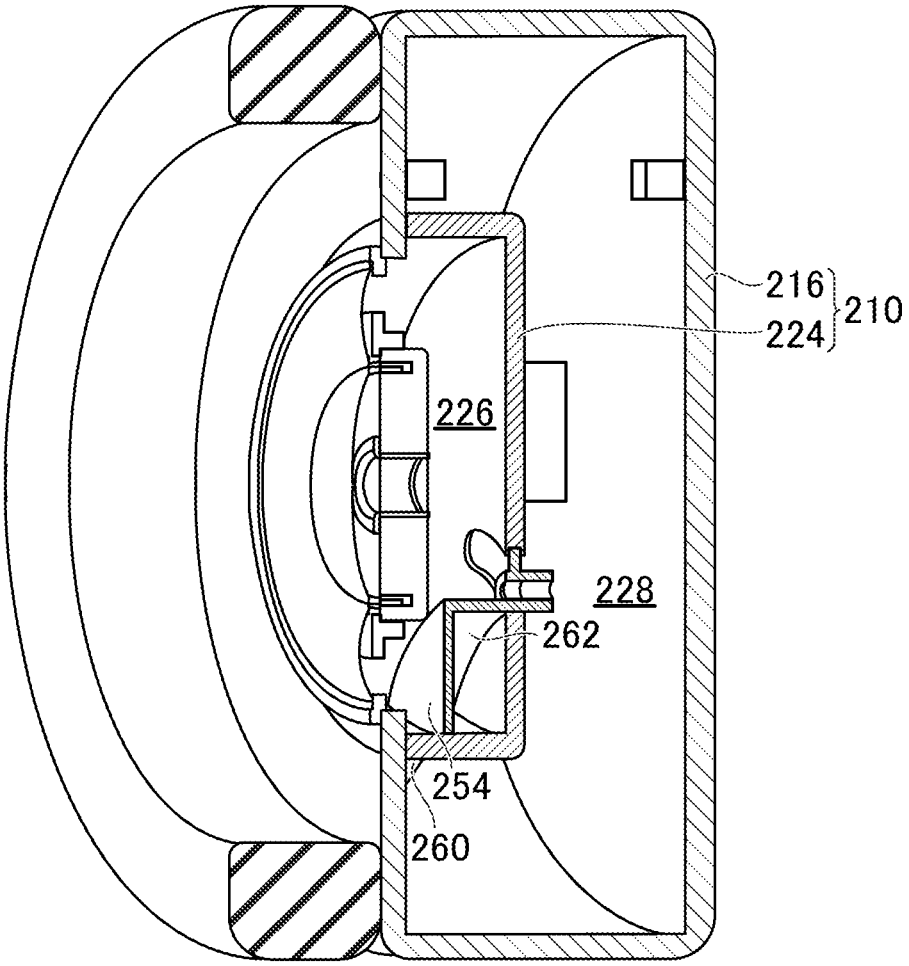
FIG. 8 is a perspective view of the housing in FIG. 7.

FIG. 6 is a plan view of a housing. FIG. 7 is a VII-VII cross-sectional view of the housing in FIG. 6. FIG. 8 is a perspective view of the housing in FIG. 7.

The adapter 254 has a depressed surface 262. A recess is constituted by the depressed surface 262. The adapter 254 is movable. At the second position P2 shown in FIG. 6, the adapter 254 is disposed to be in close contact with the inner surface of the housing 210 (inner case 224) around the depressed surface 262. The adapter 254 is movable to the first position P1. At the first position P1, the adapter 254 is positioned to be away from the inner surface of the housing 210 even around the depressed surface 262. By sliding the switch 258 outside the housing 210 (outer case 216) in the direction of the arrow, it is possible to move the adapter 254. Specifically, the switch 258 and the adapter 254 are coupled by the rod 260, the slide movement of the switch 258 causes the rod 260 to swing, causing the adapter 254 to move along a curve.

The cavity of the Helmholtz resonator is in one of the front space 226 and the rear space 228, where the adapter 254 is located (e.g., the front space 226). The resonant frequency converter is adapted to alter the resonant frequency of the Helmholtz resonator. The rod 260 moves adapter 254 to change the volume of the Helmholtz resonator cavity.

At the second position P2, the adapter 254 is positioned to be in close contact with the inner surface of the housing 210 around the depressed surface 262. The space sealed with the depressed surface 262 and the inner surface of the housing 210 (inner case 224) is excluded from the cavity of the Helmholtz resonator. Therefore, the volume of the cavity of the Helmholtz resonator is reduced, the resonance frequency is increased. At the second position P2, where the noise canceling circuit is turned on, the resonance frequency is higher than when turned off. That is, the frequency band at which the sound reduction effect can be obtained is high. Referring to FIG. 9, at the second position P2, the resonant frequency is $f_H$, the amplitude of the high-frequency band is small, and the amplitude of the low-frequency band becomes relatively large. Therefore, the noise canceling effect can be made higher in performance.

At the first position P1, the adapter 254 is positioned to be away from the inner surface of the housing 210 even around the depressed surface 262. Thus, the cavity of the Helmholtz resonator becomes larger. At the first position P1, the volume of the cavity of the Helmholtz resonator increases and the resonant frequency decreases. At the first position P1, where the noise canceling circuit is turned off, the resonance frequency is lower than when turned on. That is, the frequency band at which the sound reduction effect is obtained is low. Referring to FIG. 10, at the first position P1, the resonant frequency is $f_L$, the amplitude of the low-frequency band is small, and the amplitude of the high-frequency band becomes relatively large. Therefore, it is possible to obtain properly balanced frequency characteristics. The rest of the contents described in the previous embodiment are also applicable to the present embodiment.

While there have been described what are at present considered to be certain embodiments, it will be understood that various modifications may be made thereto, and it is intended that the appended claims cover all such modifications as fall within the true spirit and scope of the invention.

What is claimed is:

1. A headphone comprising:

an electro-acoustic transducer configured to reproduce sound from electrical signals;

a housing to which the electro-acoustic transducer is attached;

a noise cancelling circuit configured to attenuate a noise sound by adding an antiphase sound to the noise sound;

a resonant frequency converter configured to change a resonant frequency of a Helmholtz resonator configured to include a cavity in the housing and a tubular cavity communicating with the cavity; and a switch configured to perform alteration of the resonant frequency and switching of the noise cancelling circuit, in conjunction with each other.

2. The headphone of claim 1 wherein the resonant frequency converter is configured to change any one of a cross-sectional area of the tubular cavity, a length of the tubular cavity, and a volume of the cavity.

3. The headphone of claim 1 wherein the resonant frequency is higher when the noise cancelling circuit is turned on than when the noise cancelling circuit is turned off.

4. The headphone of claim 1 wherein the resonant frequency is lower when the noise cancelling circuit is turned off than when the noise cancelling circuit is turned on.

5. The headphone according to claim 1, wherein the housing includes an outer case and an inner case that partitions an inner space of the outer case into a front space having the electro-acoustic transducer and a rear space, the inner case has a through-hole penetrating between the front space and the rear space, and the through-hole is at least part of the tubular cavity of the Helmholtz resonator.

6. The headphone of claim 5, further comprising an adapter having an auxiliary through-hole, wherein the switch is adapted to switch a position of the adapter between a first position and a second position, at the first position, the adapter is disposed so that the auxiliary through-hole avoids communication with the through-hole to form an entirety of the tubular cavity from the through-hole, and at the second position, the adapter is disposed so that the auxiliary through-hole communicates with the through-hole to form the tubular cavity from the through-hole and the auxiliary through-hole.

7. The headphone of claim 6, wherein the Helmholtz resonator includes:

a first Helmholtz resonator in which the cavity is in the front space; and a second Helmholtz resonator in which the cavity is in the rear space.

8. The headphone of claim 5, further comprising an adapter having a depressed surface, wherein the switch is configured to switch a position of the adapter between a first position and a second position, at the first position, the adapter is disposed so that a portion around a depressed surface is in close contact with an inner surface of the housing, to exclude a space sealed with the depressed surface and the housing from the cavity, and at the second position, the adapter is disposed so that a portion around the depressed surface is away from the inner surface of the housing.

9. The headphone of claim 8, wherein the cavity of the Helmholtz resonator is in one of the front space and the rear space, where the adapter is located.

* * * * *